US005314168A

United States Patent [19]

Omae et al.

[11] Patent Number: 5,314,168

[45] Date of Patent: May 24, 1994

[54] APPARATUS AND METHOD FOR CONTROLLING OPERATION OF QUENCHING CAR/BUCKET FOR COKE OVEN

[75] Inventors: Yoshihiro Omae; Haruo Watanabe; Susumu Sonoki; Yoichi Kanemasa; Kazuo Sagara; Takashi Yoshimune; Tetsuo Yamasaki, all of Kitakyushu, Japan

[73] Assignee: Mitsubishi Kasei Corporation, Tokyo, Japan

[21] Appl. No.: 91,373

[22] Filed: Jul. 15, 1993

Related U.S. Application Data

[62] Division of Ser. No. 734,761, Jul. 23, 1991, Pat. No. 5,253,846.

[30] Foreign Application Priority Data

| | | | |
|---|---|---|---|
| Nov. 7, 1990 | [JP] | Japan | 2-299740 |
| Jul. 24, 1992 | [JP] | Japan | 2-193884 |
| Jul. 24, 1992 | [JP] | Japan | 2-193885 |
| Jul. 24, 1992 | [JP] | Japan | 2-193886 |
| Aug. 28, 1992 | [JP] | Japan | 2-224492 |
| Nov. 7, 1992 | [JP] | Japan | 2-299739 |

[51] Int. Cl.[5] ..... C21B 13/06

[52] U.S. Cl. ..... 266/92; 266/276; 266/142; 266/143

[58] Field of Search ..... 266/44, 78, 92, 99, 266/165, 276, 142, 143; 202/96, 103, 113, 117, 248, 212; 432/1, 51, 45

[56] References Cited

U.S. PATENT DOCUMENTS

| | | | |
|---|---|---|---|
| 647,610 | 4/1900 | Hartman | 266/165 |
| 4,978,105 | 12/1990 | Meierling | 266/276 |
| 5,253,846 | 10/1993 | Omae et al. | 266/44 |

OTHER PUBLICATIONS

"The Making Shaping and Treating of Steel", 7th edition, pp. 106-112 Jan. 27, 1958.

*Primary Examiner*—Scott Kastler

*Attorney, Agent, or Firm*—Oblon, Spivak, McClelland, Maier & Neustadt

[57] ABSTRACT

An apparatus for controlling drive or operation of a quenching car and/or a bucket car for a coke oven and a method therefor, capable of effectively accomplishing the automatic control of the operation of the quenching car/bucket car. A quenching car/bucket car is adapted to travel on a track due to traction by a wire rope through a winch structure, to thereby reduce the load of the quenching car/bucket car applied to the track surface to prevent positional variations on the track surface. This results in the relative positional relationship of the track surface to a quenching tower, a coke wharf/CDQ and the like being ensured.

17 Claims, 11 Drawing Sheets

APPARATUS AND METHOD FOR CONTROLLING OPERATION OF QUENCHING CAR/BUCKET FOR COKE OVEN

This is a division, of application Ser. No. 07/734,761, filed on Jul. 23, 1991, now U.S. Pat. No. 5,253,846.

BACKGROUND OF THE INVENTION

This invention relates to an apparatus for controlling the drive of and/or the operation of a quenching car/bucket car for a coke oven as well as a method therefor, and more particularly to an apparatus for effectively accomplishing the automatic control of the operation of the quenching car/bucket car and a method therefor.

Conventionally, the control of the drive and/or operation of a quenching car for a coke oven is generally carried out by an operator riding in an electric car drawing the quenching car. Now, the manner or procedure of controlling operation of the quenching car will be described. First, when red-hot coke, as calcined is pushed out, by means of a pusher, from a designated one of the coking chambers of a coke oven from which the coke is to be delivered while keeping the pusher, a guide car and a quenching car accurately registered or aligned with respect to the designated coking chamber, it is charged onto the quenching car of which a door is kept closed while causing the quenching car to travel in correspondence with the speed of the coke pushed out. After the charging is completed, the quenching car is moved into a quenching tower and located accurately at a predetermined position in the quenching tower. Then, water is sprinkled from a water tank arranged above the quenching tower on the red-hot coke charged onto the quenching car to quench the coke and then the water is drained off from the coke. Subsequently, the quenching car is moved to coke wharves and then accurately stopped at a predetermined position in front of designated one of coke wharves. Thereafter, the door of the quenching car is opened to discharge the quenched coke onto the wharf. Thus, the processing of calcined coke is completed. The above-described procedure is repeated with respect to each of the coking chambers in order, resulting in the delivery of coke from the coking oven being carried out.

The control of drive of a bucket car for a coke oven is likewise carried out by an operator riding in an electric car drawing the bucket car. More particularly, red-hot coke as calcined is pushed out or discharged, by means of a pusher, from designated one of coking chambers of a coke oven from which coke is to be delivered while keeping the pusher, a guide car and a bucket car accurately located or aligned with respect to the designated coking chamber. The discharged coke is then charged into a coke bucket on the bucket car. Subsequently, the bucket car is moved to a coke dry quenching facility (hereinafter referred to as "CDQ") and accurately located at a predetermined position in CDQ. Then, the coke bucket in which the red-hot coke is charged is hung up by means of a charging crane to cause the coke to be subject to a dry quenching treatment. The coke bucket which has thus been rendered empty is then placed down into the bucket car for the next operation. The above-described operation is repeated with respect to each of the coking chambers, resulting in the delivery of coke from the coking oven to the bucket car being carried out.

For the operation of the quenching car/bucket car for the coke oven, the correlation between the quenching car/bucket car and other working machines such as the guide car, pusher and the like is highly important. To this end,, it is generally required that workers or operators carefully and closely maintain contact with each other using a communication means such as a wire telephone, a wireless telephone or the like to verify with each other the working condition of the working equipment, such as its working position or the like.

However, the artificial or manual operation of the quenching car/bucket car carried out while the operators maintain contact with each other is apt to cause exchange of incorrect information due to misunderstanding or the like, resulting in the operators often failing to carry out the operation while properly grasping the working situation, the working position and the like.

In view of the foregoing, an automatic control means is proposed for successively automatically controlling the operation of the working machines such as the pusher, guide cat, quenching car/bucket car and the like. However, taking, as an example, a track surface on which the working position of the quenching car/-bucket car is determined, lots of load is applied onto the track surface because the sum of weight of the quenching car/bucket car and weight of the electric car traveling while drawing the quenching car/bucket car reaches a high level such as, for example, 90 tons (−55 tons (quenching car) +35 tons (electric car)). This causes the positional relationship of the track surface to a body of the coke oven, the quenching tower, the coke wharf/CDQ and the like to be readily varied, so that the track surface fails to serve as a reference surface for the operation of the quenching car/bucket car, resulting in a failure to permit the automatic control to be effectively carried out. Also, in order to permit the track surface to endure such high load as described above, it is required that there is a rigid concrete foundation to strengthen the track surface. Unfortunately, this leads to a problem of increased costs.

SUMMARY OF THE INVENTION

The present invention has been made in view of the foregoing disadvantage of the prior art.

Accordingly, it is an object of the present invention to provide an apparatus for controlling the operation of a quenching car/bucket car for a coke oven, which is capable of significantly improved operations with respect to the driving of the quenching car/bucket car.

It is another object of the present invention to provide an apparatus for controlling the operation of a quenching car/bucket car for a coke oven which is capable of effectively carrying out the automatic operation of the quenching car/bucket car.

It is another object of the present invention to provide a method for controlling the operation of a quenching car/bucket car for a coke oven which is capable of significantly improving the operation of driving the quenching car/bucket car.

It is another object of the present invention to provide a method for controlling the operation of a quenching car/bucket car for a coke oven which is capable of effectively carrying out the automatic operation of the quenching car/bucket car.

In order to accomplish the above-described object, the present invention is constructed so as to permit a quenching car/bucket car to travel due to traction caused by a wire rope passing through a winch structure, to thereby reduce the load of the quenching car as it is applied to a track surface to prevent any positional variations with respect to the track surface. Such a construction permits the relative positional relationship of the track surface and therefore the quenching car/-bucket car to a quenching tower, a coke wharf/CDQ and the like to be ensured. This also provides that the operation control system to be significantly simplified, resulting in the operation and control of the quenching car being efficiently and positively accomplished.

In accordance with one aspect of the present invention, there is provided an apparatus for controlling the operation of a quenching car for a coke oven in which the quenching car is actuated in association with a pusher to travel on a track and charged with calcined coke pushed out from a designated coking chamber of the coke oven by the pusher. The quenching car is then moved into a quenching tower for quenching the coke and then moved to designated one of coke wharves for discharging the coke to the coke wharf. The apparatus comprises a quenching car operating means for connecting a wire rope to the quenching car and drawing the wire rope due to driving of a winch structure to reciprocate the quenching car on the track; a traveling position detecting means for detecting a required operational position of the quenching car on the track depending upon the amount of driving of the winch structure; and an operational position detecting means for confirming approach of the quenching car to a position at which coke is delivered from the designated coking chamber, a quenching position in the quenching tower and a position at which coke is discharged from the quenching car to the designated coke wharf; whereby a desired operation is carried out according to a preset operation program when detection of the required operational position of the quenching car by the traveling position detecting means and confirmation of the operational position of the quenching car by the operational position detecting means coincide with each other.

In accordance with another aspect of the present invention, there is provided a method for controlling the operation of a quenching car for a coke oven in which the quenching car is actuated in association with a pusher to travel on a track and charged with calcined coke pushed out from a designated coking chamber of the coke oven by the pusher and the quenching car is moved into a quenching tower for quenching the coke and then moved to designated one of coke wharves for discharging the coke to the coke wharf. The method comprises the steps of providing a quenching car operating means for connecting a wire rope to the quenching car and drawing the wire rope due to driving of a winch structure to reciprocate the quenching car on the track; detecting the amount of driving of the winch structure to output required operational position data of the quenching car on the track; confirming the approach of the quenching car to a position at which the quenching car is to receive coke from the designated coking chamber, a quenching position in the quenching tower and a position at which coke is discharged from the quenching car to the designated coke wharf to output operational position confirming data; and carrying out control so as to permit a desired operation to take place depending upon coincidence between the required operational position data of the quenching car and the operational position confirming data.

In accordance with a further aspect of the present invention, there is provided an apparatus for controlling the operation of a bucket car for a coke oven in which the bucket car is actuated in association with a pusher to travel on a track and includes a coke bucket charged therein with calcined coke pushed out from a designated coking chamber of the coke oven by the pusher and the bucket car is moved into a coke dry quenching facility for quenching the coke. The apparatus comprises a bucket car operating means for connecting a wire rope to the bucket car and drawing the wire rope due to driving of a winch structure to reciprocate the bucket car on the track; a traveling position detecting means for detecting a required operational position of the bucket car on the track depending upon the amount of driving of the winch structure; and an operational position detecting means for confirming approach of the bucket car to a position at which coke is delivered from the designated coking chamber to the bucket car, a quenching position in the coke dry quenching facility and other desired positions; whereby a desired operation is carried out according to a preset operation program when detection of the required operational position of the bucket car by the traveling position detecting means and confirmation of the operation position of the bucket car by the operational position detecting means coincide with each other.

In accordance with still another aspect of the present invention, there is provided a method for controlling the operation of a bucket car for a coke oven in which the bucket car is actuated in association with a pusher to travel on a track and charged with calcined coke pushed out from a designated coking chamber of the coke oven by the pusher and the bucket car is moved with respect to a coke dry quenching facility to quench coke. The method comprises the steps of providing a bucket car operating means for connecting a wire rope to the bucket car and drawing the wire rope due to driving of a winch structure to reciprocate the bucket car on the track; detecting the amount of driving of the winch structure to output required operational position data of the bucket car on the track; confirming approach of the bucket car to a position at which the bucket car receives coke from the designated coking chamber, a position in the coke dry quenching facility at which the bucket car is stopped, and other operational positions to output operational position confirming data; and carrying out control so as to permit a desired operation to take place depending upon coincidence between the required operational position data of the bucket car and the operational position confirming data.

The present invention, as described above, is constructed so as to permit a quenching car/bucket car to travel due to traction by a wire rope through a winch structure. Such construction permits load of the quenching car/bucket car applied to a track surface to be substantially reduced to prevent a positional variation of the track surface; so that the relative positional relationship of the track surface and therefore the quenching car/bucket car to a quenching tower, a coke wharf/CDQ and the like may be ensured. This further allows that the operation control system may be significantly simplified, resulting in the operation and control of the quenching car/bucket car being efficiently and positively accomplished, and the cost of equipment may be sharply reduced. Also, in the present invention, a desired operation is carried out according to tile preset operation program when detection of the required operational position of the quenching car by the traveling position detecting means and confirmation of the operational position of the quenching car by the operational position detecting means coincide with each other; accordingly, the operation by the quenching car/bucket car and therefore the operation of delivery of coke from the coke oven may be efficiently and satisfactorily accomplished.

Further, the wire rope stretching means is provided with respect to the wire rope acting as a traction means, to thereby effectively absorb any extension and/or looseness in the wire rope. This prevents slippage of the wire rope on the drive drum. This results in the position of the quenching car/bucket car traveling on the track being accurately grasped or detected depending upon the amount of driving of the winch structure. In addition, the arrangement of an urgent stopping means detects any abnormal extension or break in the wire rope to quickly stop the quenching car/bucket car, thereby preventing any trouble or accident from occurring due to abnormality in the traction produced by the wire rope. Moreover, the arrangement of an out-of-range detection means permits out-of-range traveling of said bucket car to be positively detected, to thereby quickly stop the bucket car when the out-of-range detection means detects out-of range traveling of the bucket car.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Figure 1:
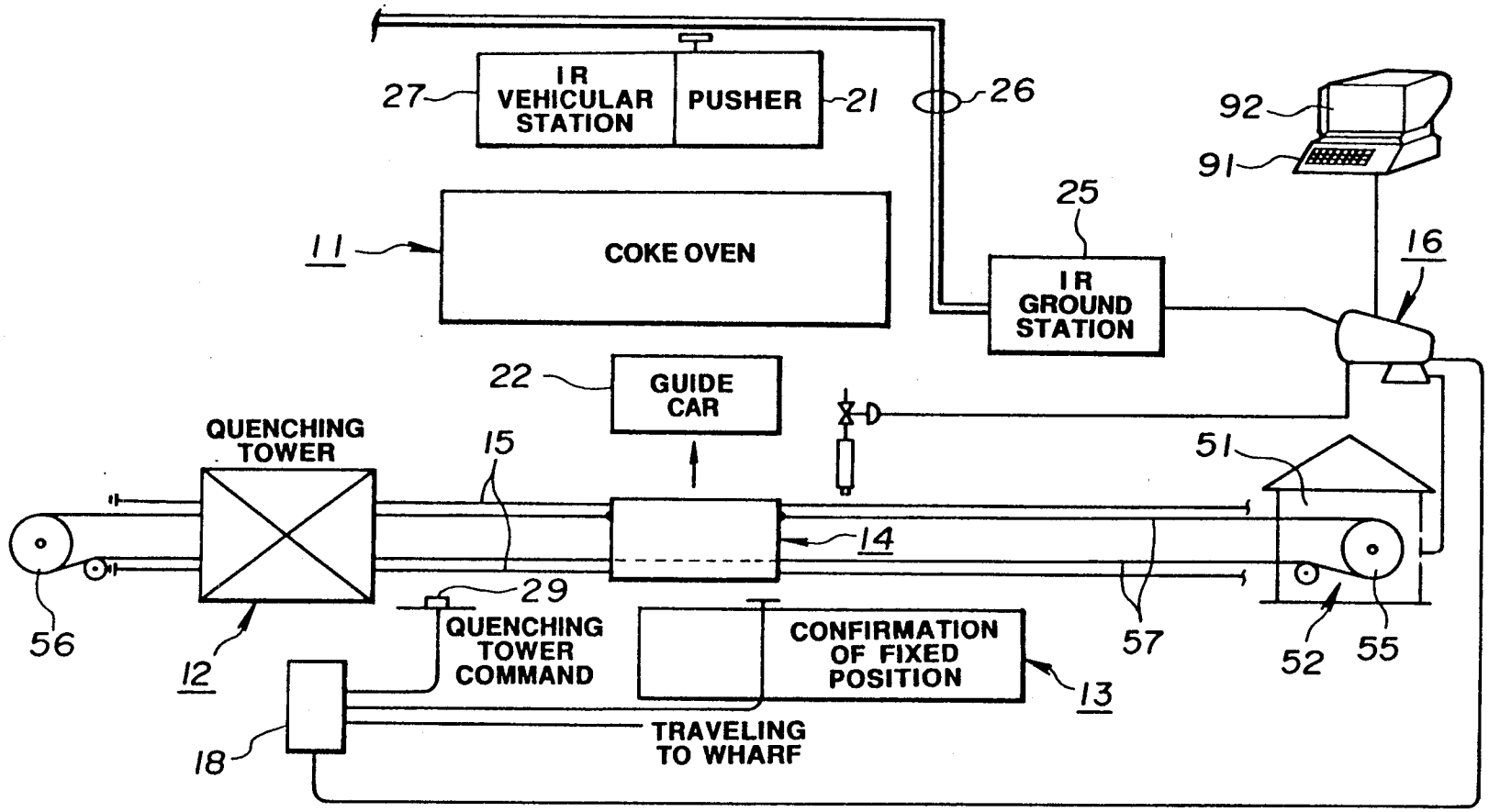
FIG. 1 is a diagrammatic view schematically showing an embodiment of an apparatus for controlling operation of a quenching car/bucket car for a coke oven according to the present invention together with the positional relationship of the apparatus to a coke oven, a quenching tower and a coke wharf, wherein the operation of a quenching car is controlled.

Now, an apparatus for controlling the drive or operation of a quenching car/bucket car for a coke oven and a method therefor according to the present invention will be described hereinafter with reference to the accompanying drawings.

FIGS. 1 through 5 illustrate an embodiment of an apparatus for controlling the operation of a quenching car for a coke oven according to the present invention, wherein reference numeral 11 designates a coke oven, 12 is a quenching tower, 13 is coke wharves, 14 is a quenching car adapted to travel on a track 15 arranged in correspondence to the above-described facilities 11 to 13 while being controlled, and 16 is a system operation control unit having a sequencer 18 connected thereto through a multiplex transmission unit 17.

The coke oven 11 includes a plurality of coking chambers arranged side by side and is adapted to subject a stock material or coal charged in the respective coking chambers to calcination in turn. With respect to the coke oven 11, various working machines are arranged in such a manner as is well known in the art which include a pusher 21 for pushing out calcined red-hot coke from the coking chambers in order of completion of calcination, a guide car 22 for guiding the pushed-out or discharged red-hot coke so as to permit the coke to be charged onto the quenching car 14, a charging car (not shown) for charging coal into the coking chambers, and the like. Proximity switches 23 are arranged so as to be in correspondence to with the respective coking chambers to permit the quenching car 14 to be accurately stopped at predetermined positions with respect to or in front of the coking chambers, resulting in detecting when the quenching car 14 is stopped at the predetermined positions, as indicated at reference numeral 24. In addition, an actuator 26 is arranged for each of the coke wharves 13 to operate a door of the quenching car 14 moved to a predetermined position of the wharf for transferring coke from the quenching car 14 to the wharf 13.

The control of the driving and/or operation of the pusher 21 may be carried out in the similar manner, as the methodologies found in the prior art. For example, it may be carried out through an IR ground station 25, a twin-lead type inductive radio line 26 and an IR vehicular station 27 mounted on the pusher 21 in response to controls or commands generated from the system operation control unit 16. The guide car 22 is adapted to be driven or operated in association with traveling of the pusher 21 and includes a limit switch 28 for confirmation of the stopping of the quenching car 14 at predetermined positions.

The quenching tower 12 serves to quench red-hot coke charged onto the quenching car 14 and is arranged on the proximal end side of the track 15. The quenching tower 12 is formed such that at the lower portion of the interior thereof there is a quenching space section 31 and further so that there is provided at the upper portion thereof with a water tank 32 for storing water used for quenching coke, a quenching nozzle 33 and the like. Also, a monitor and control unit 34 are provided for monitoring a water level in the water tank 32 and controlling the replenishment of water to the water tank 32 and a sprinkler 35 for sprinkling red-hot coke with water through the quenching nozzle 33. The water's release is controlled and actuated by means of the sequencer 18 depending upon a control command supplied from the system operation control unit 16.

Figure 2A:
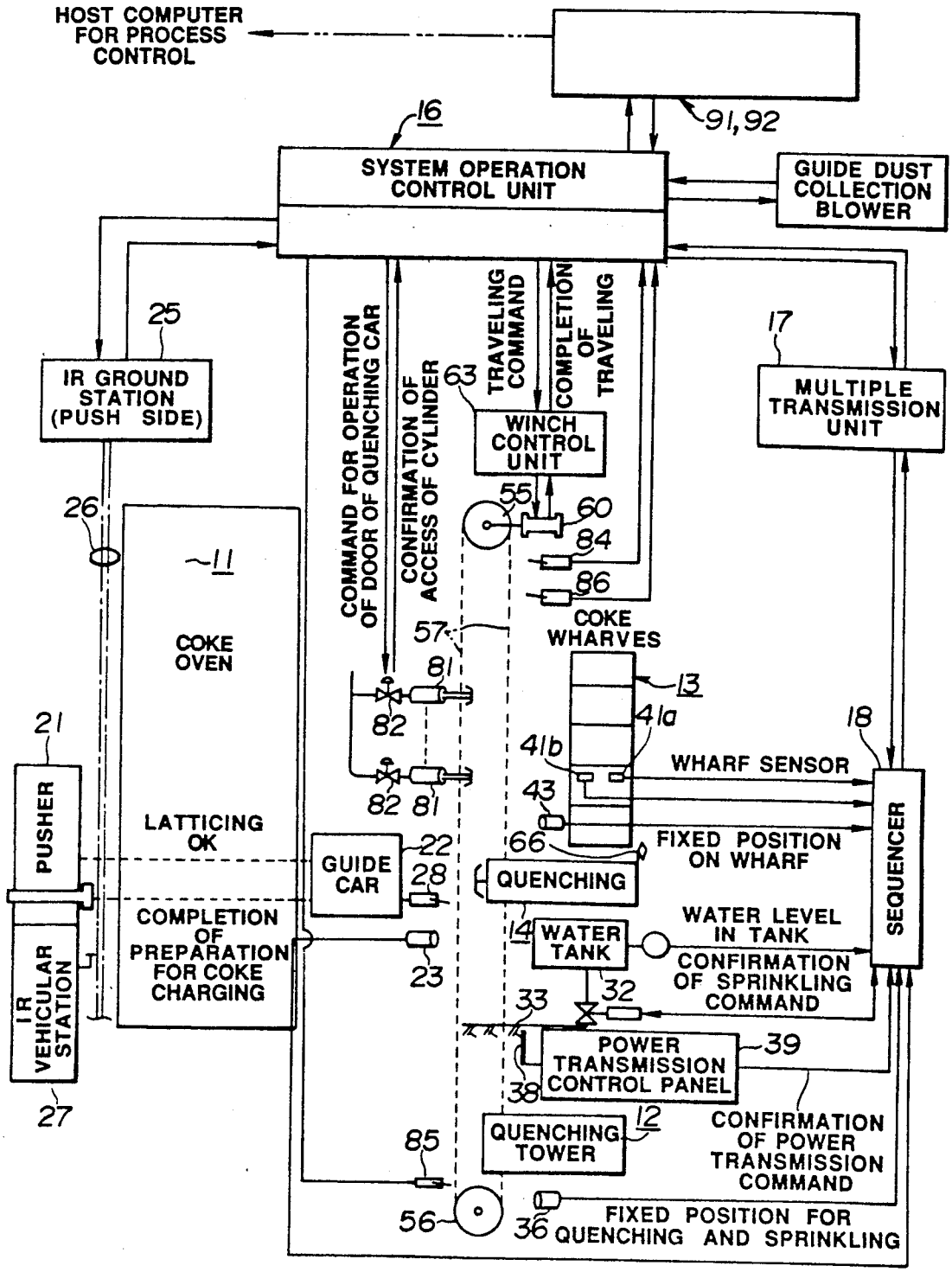
FIG. 2A is a block diagram schematically showing the general construction of an operation control system for a pusher in the apparatus shown in FIG. 1.

The quenching tower 12 is provided with a proximity switch 36 for detecting when the quenching car 14 has reached a position predetermined in the quenching space section 31 in the quenching tower 12. Such detection of stopping of the quenching car 14 at the predetermined or fixed quenching position by the switch 36 is indicated at reference numeral 37 in the drawings. The precise stopping of the quenching car 14 at the predetermined stop position is carried out depending upon a control command generated from the system operation control unit 16. Also, as shown in FIG. 2A, a conductive shoe 38 is arranged which is adapted to be turned on depending upon a detection signal generated from the proximity switch 36 to supply the quenching car 14 stopped at the approach position with electric power. The conductive shoe 38 is connected to a power transmission control panel 39.

The coke wharves 13 each are adapted to receive thereon coke quenched on the quenching car 14 and then discharged therefrom. The designation which of the desired one of the coke wharves 13 to which coke is to be discharged is carried out by means of detection sensors 41*a*, 41*b* . . . , which are respectively arranged with respect to the coke wharves 13 so as to detect whether coke has already been received at the corresponding coke wharves, as indicated as "DETECTION OF RECEIVING OF COKE", at reference numeral 42, depending upon a control command supplied from the system operation control unit 16 through the sequencer 18. Also, the stopping of the quenching car 14 at the coke wharf 13, thus designated is likewise carried out by means of proximity switches 43 which are respectively arranged with respect to the coke wharves 13, as indicated as "DETECTION OF STOPPING AT FIXED POSITION ON WHARF", at reference numeral 44, depending upon a control command supplied from the system operation control unit 16 through the sequencer 18.

The quenching car 14, as described above, is charged with red-hot coke pushed out from the coking chamber of the coke oven 11 by means of the pusher 21. Then, the quenching car 14 quenches it in readiness for the next step of discharging it onto the designated coke wharf 13. The quenching car 14 is moved by drawing it by means of a wire rope for traction.

More particularly, a machine room 51 for permitting the quenching car 14 to travel is arranged on the proximal end side of the track 15. The machine room 51 is provided therein with a brake drum 54 and a winch structure 52 equipped with a brake mechanism 53. Also, a wire rope 57 is arranged in a manner to be multiplexly wound on a drive drum 55 of the winch structure 52 and connected through a driven drum 56 arranged on the proximal end side of the track 15 to the front and rear portions of a body of the quenching car 14. Such construction leads to the controlled rotation of the drive drum 55 in both directions or the driving of the drive drum 55 due to controlled drawing by the wire rope through the winch, resulting in the quenching car 14 traveling reciprocatedly along the track 15 with respect to the coke oven 11, quenching tower 12 and coke wharves 13 while allowing the car to be stopped at predetermined positions by control signals controlled by the proximity switches 23, 36 and 43 which are arranged, for example at the coke oven 11 and coke wharves 13.

Also, a wire rope stretching means is arranged which functions to absorb extension of the wire rope 57, as well as looseness in the wire rope 57 which might occur, for example at the start of travel of the quenching car 14. This thereby prevents slippage of the wire rope 57 on the drive drum 55. The wire rope stretching means includes a main-weight mechanism 58 arranged on one return side of the wire rope 57 which is not directly connected to the body of the quenching car 14 and a sub-weight mechanism 59 arranged on the other return side of the wire rope 57 which is directly connected to the body of the quenching car 14. This arrangement of the weight mechanisms 58 and 59 keeps the wire rope 57 stretched to a desired degree during traveling of the quenching car 14 by traction.

Figure 2B:
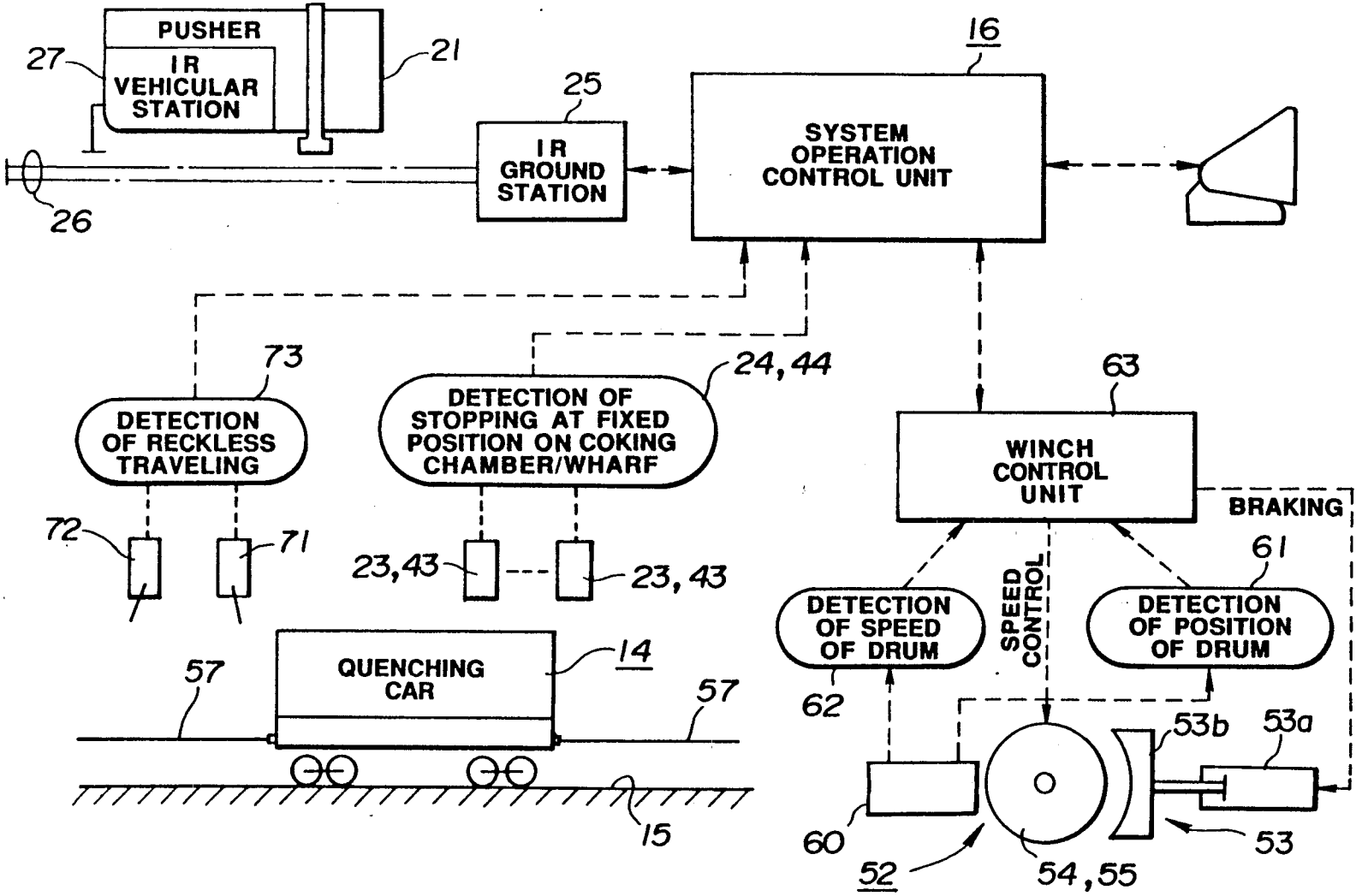
FIG. 2B is a block diagram schematically showing the general construction of an operation control system for a quenching car in the apparatus shown in FIG. 1.

The winch structure 52 is provided with an encoder 60 acting as a relative address position detecting means which functions to carry out the detection of the rotation and angular rotational position of the drive drum 55 as indicated as "DETECTION OF POSITION OF DRUM", at reference numeral 61 in FIG. 2B and the detection of rotational speed of the drive drum as indicated as "DETECTION OF SPEED OF DRUM", at reference numeral 62 therein to generate detection data and feedback data with respect to the so-obtained detection data to a winch drive control unit 63. The control of rotation of the drive drum 55 in both directions through the winch structure 52 is carried out by means of the winch drive control unit 63 based on the detection data supplied thereto depending upon a control command supplied from the system operation control unit 16. To this end, the quenching car 14 is positioned at each of predetermined address positions. Concurrently, an actuator 53*a* of the brake mechanism 53 is controlled by the winch control unit 63 to control the brake drum 54 through a brake shoe 53*b*, so that the quenching car 14 may be accurately stopped at each of the predetermined address positions.

Thus, in the illustrated embodiment, the traveling of the quenching car 14 on the track 15 is curried out due to traction by the wire rope through the winch structure 52 depending upon the control command fed thereto from the winch drive control unit 63, so that the load applied onto the track 15 is reduced. This reduction is on the of a level of one half as much as the level that is caused due to traction of a conventionally arranged quenching car with its attached electric, resulting in effectively preventing the track from having positional variations due to an excessive load being placed on the track. Thus, the illustrated embodiment permits the surface of the track 15 to be safely and accurately placed with respect to the oven body of the coke oven 11, the quenching tower 12 and the coke wharves 13, resulting in the quenching car 14 being positively located at each of the relative address positions and a trolley line conventionally required to feed the quenching car with electric power being eliminated.

In addition, the illustrated embodiment includes an absolute address correcting means arranged at a suitable position on the track 15 on which the quenching car 14 travels. This absolute address correcting means is adapted to detect when the quenching car 14 passes therethrough to correct for any extension that might exist with respect to the wire rope 57 in time to define a reference address position for stopping the quenching car at any desired absolute address position on the track 15 or at each of the predetermined address positions by traction provided by the wire rope, to thereby correct the quenching car drive data in the winch drive control unit 63 through the system operation control unit 16.

A suitable switch means 86 such as, for example, a limit switch, a sensitive proximity switch or the like, may be used as the absolute address correcting means so long as it can detect passage of the quenching car 14 to generate a passing data. The switch means 86 permits the reference address to be detected irrespective of the amount of extension of the wire rope 57.

Thus, the absolute address correcting means for the quenching car 14 constantly automatically corrects the extension of the wire rope 57 with time to ensure the reference address position, so that the track 17 with respect to the oven body of the coke oven 11, the quenching tower 12 and the coke wharves 13 and therefore the absolute address position of the quenching car 14 may be positively ensured.

Figure 4A:
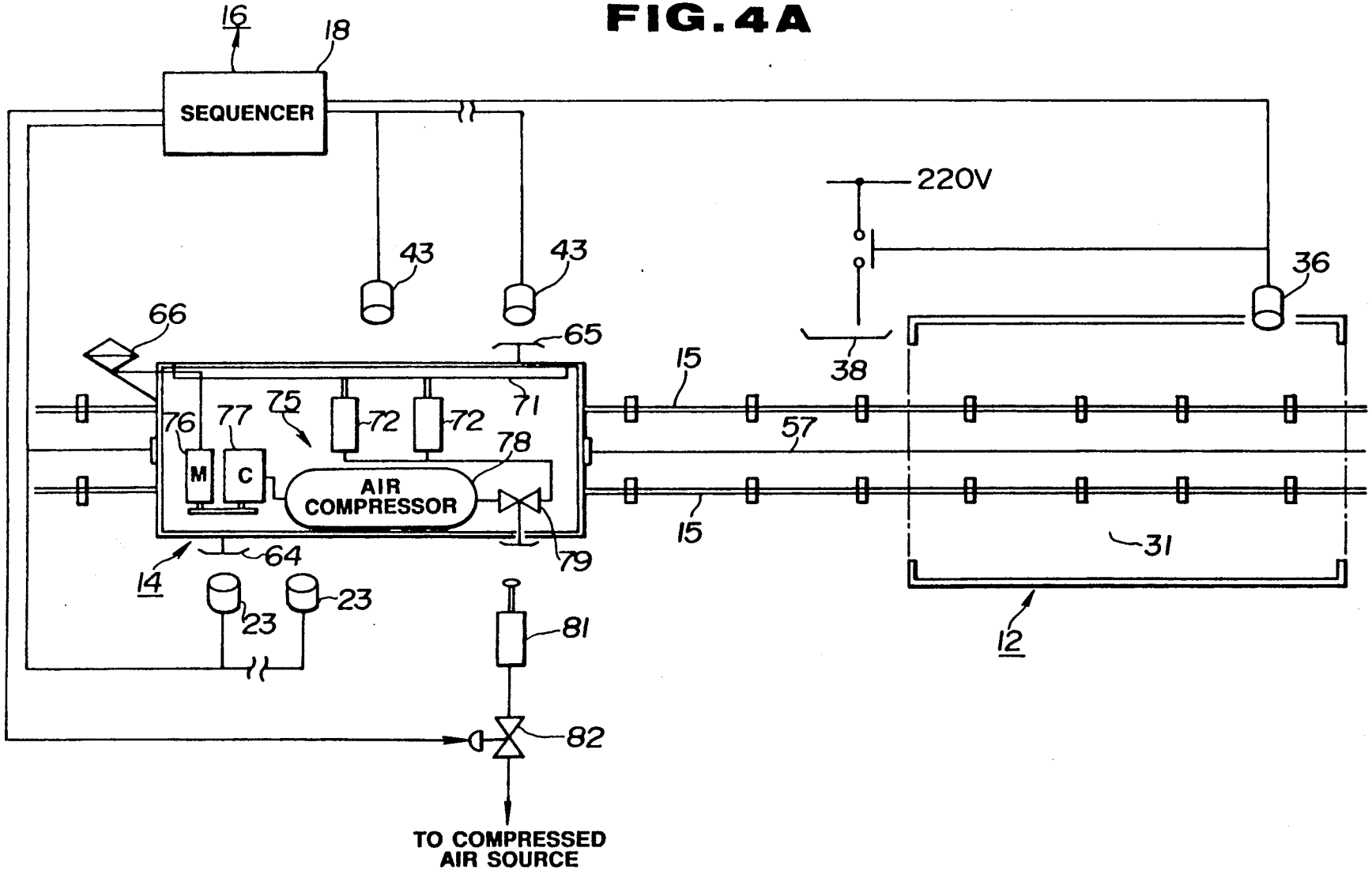
FIG. 4A is a diagrammatic view showing an actuation means for the operation of a door of a quenching car.
Figure 4B:
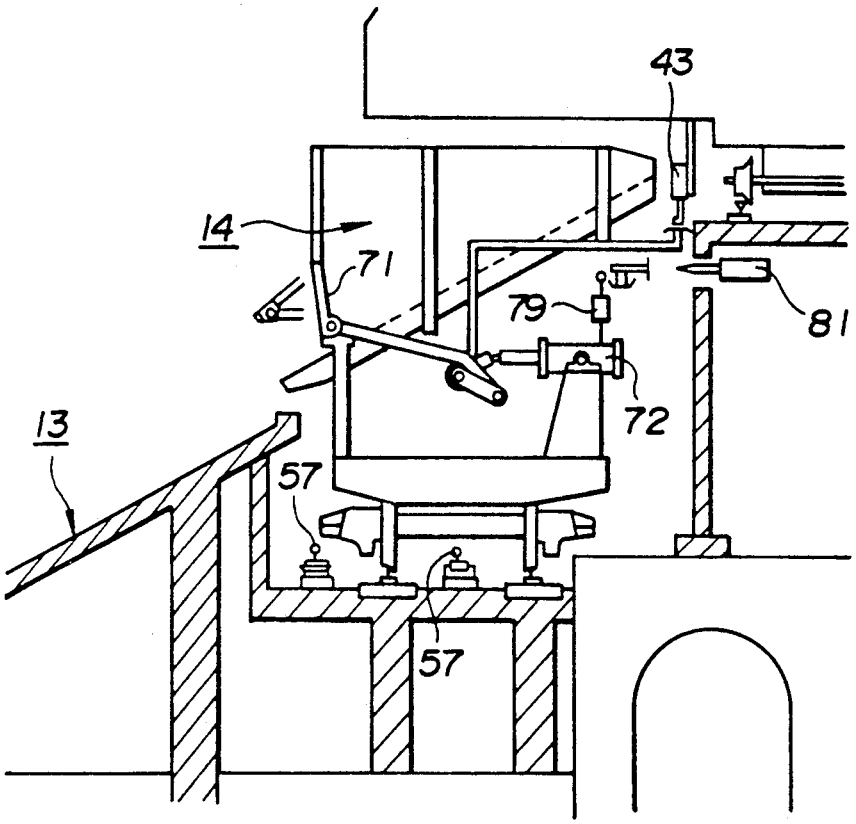
FIG. 4B is a diagrammatic view showing a confirmation means for a quenching car.
Figure 4C:
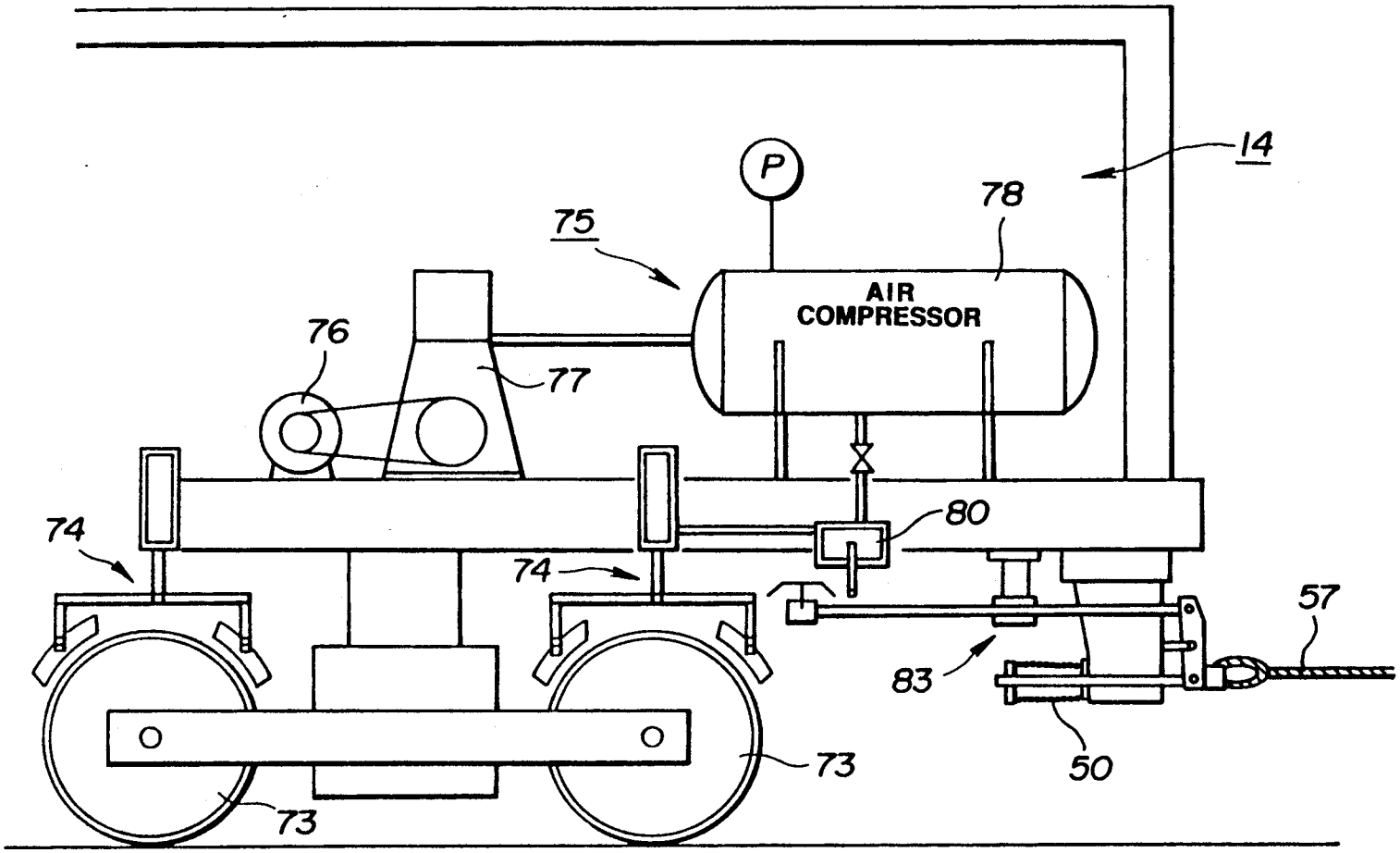
FIG. 4C is diagrammatic view showing a means for urgently stopping a quenching car.
Figure 5A:
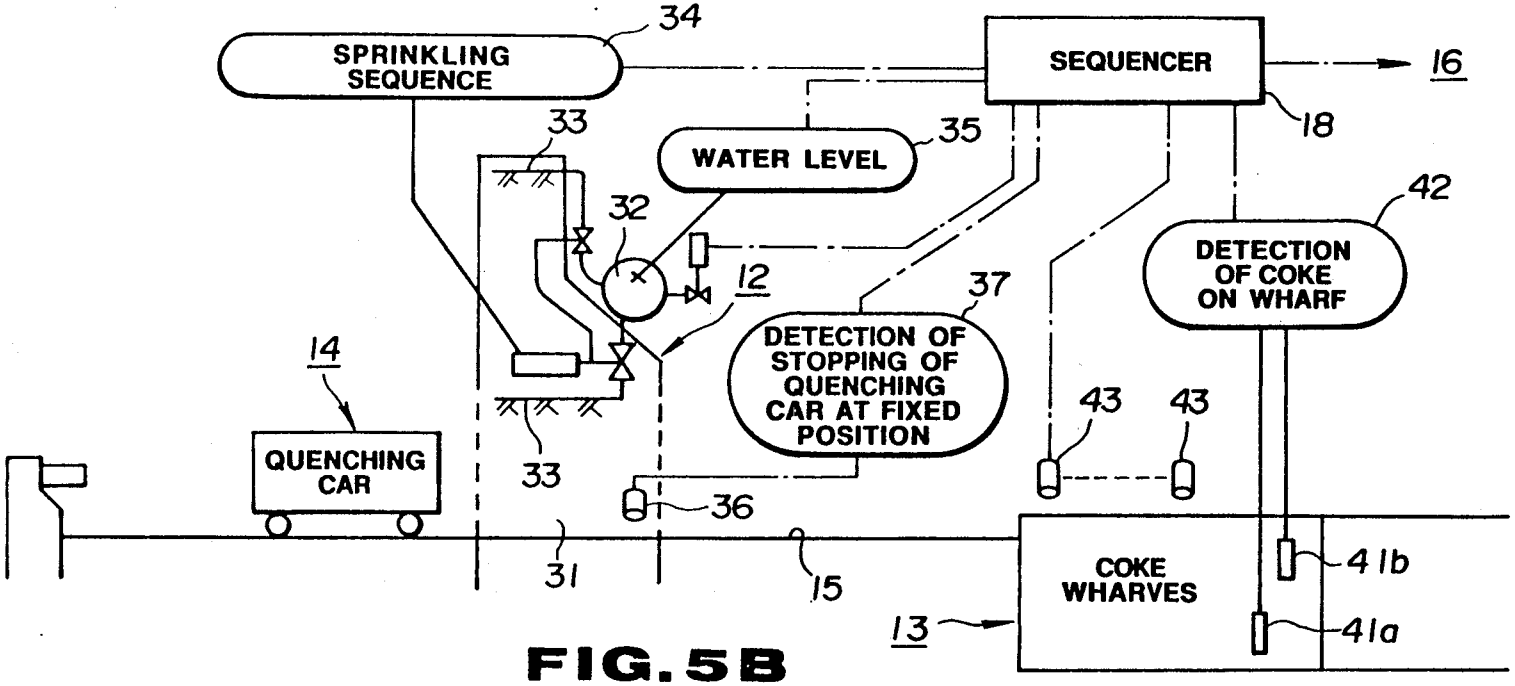
FIG. 5A is a diagrammatic view showing a quenching system in the apparatus shown in FIG. 1.
Figure 5B:
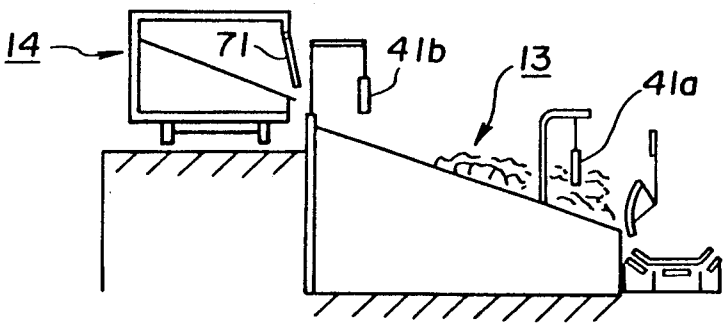
FIG. 5B is a diagrammatic view showing a system of charging a coke wharf with coke in the apparatus shown in FIG. 1.

The track 15 is provided on the proximal and distal ends thereof with limit switches 84 and 85 for regulating the range of traveling of the quenching car 14 on the track 17. The quenching car 14, as shown in FIG. 4A, includes a metal plate 64 arranged so as to correspond to the proximity switch 23 for the detection of stopping of the quenching car 14 at predetermined positions in front of the coking chambers, as indicated by reference numeral 24. A metal plate 65 is arranged to correspond to the proximity switches 36 and 43, which are employed to carry out the detection of stopping of the quenching car 14 at the predetermined position as indicated by reference numeral 37 and the detection of stopping of the quenching car 14 at predetermined positions on the wharf as indicated by reference numeral 44, respectively. A current collector 66 to which electric power is supplied from the conductive shoe 38 depending upon the detection of stopping the quenching car 14 at the fixed position, is indicated by reference numeral 37.

Also, the quenching car 14 has an air compressor structure 75 mounted thereon for operating a door 71, through a pneumatic cylinder operation mechanism 72 and also for operating the braking wheels 73 through a pneumatic cylinder brake mechanism 74. In the illustrated embodiment, the air compressing structure 75 comprises a motor 76, an air compressor 77 and an air tank 78. The air compressor structure 75 is actuated by electric power fed from the current collector thereto for a period of time during which the quenching operation takes place in the quenching tower 12, resulting in a required amount of compressed air being stored under a required pressure in the air tank 78.

The compressed air which is stored in this manner is fed through change-over valves 79 and 80 to the pneumatic cylinder operation mechanism 72 and the pneumatic cylinder brake mechanism 74, respectively. In the pneumatic cylinder operation mechanism 72, when the quenching car 14 is stopped at a designated one of coke wharves 13, the change-over valve 79 is operated through the corresponding one of door operation command pneumatic cylinders 81 arranged with respect to the respective coke wharves 13, so that the door 71 is operated, resulting in coke being discharged from the quenching car 14. The actuation of the door operation command pneumatic cylinder 81 is controlled through a change-over valve 82 controlled by the sequencer 18. Also, in the pneumatic cylinder brake mechanism 74, when a tension detecting mechanism 83 provided on quenching car 14 for detecting the tension of the wire rope 57 detects any trouble of the wire rope such as break or cut of the wire rope or the like, it causes the change-over valve 80 to be open to quickly and to quickly and urgently brake the wheels 73, resulting in the quenching car 14 being immediately stopped at that position.

In the illustrated embodiment, the quenching car 14 has the air compressing structure 75 mounted thereon which comprises the motor 76, air compressor 77 and air tank 78 and is provided with the change-over valve 80 for discharging therethrough the compressed air stored in the air tank. Also, the quenching car 14 is provided at the portion thereof to which the wire rope 57 is connected with the tension detecting mechanism 83 for quickly stopping the quenching car 14, which, in the illustrated embodiment, comprises a tension spring 50 exhibiting a predetermined level of tension, a bell crank 71 and an actuation element 72.

When any abnormality in the tension of the wire rope 57 such as looseness of the wire rope 57 over a predetermined level, a cut or break occurs the wire rope or the like, tension imparted to the wire rope by the tension spring 50 causes the—actuation element 72 to be actuated through the bell crank 71 to open the change-over valve 80, to thereby cause compressed air to be fed to an actuator **16*a* of the pneumatic cylinder brake mechanism 74, resulting in braking of the wheels 73 and therefore the quick and urgent stopping of the quenching car 14** is accomplished.

Further, as described above, the limit switches 84 and 85 are arranged at the proximal and distal ends of the track 15 to regulate the range of traveling of the quenching car 14, to thereby carry out detection of any reckless travel of the quenching car 14, as indicated at reference numeral 73 in FIG. 2B. In addition, a further limit switch 86 is arranged at another predetermined position so as to detect an absolute address on the track 15 and therefore an absolute address of the wire rope 57 with respect to the control system for the quenching car 14, resulting in carrying out any necessary corrections.

When the quenching car 14 travels to the proximal or distal end of the track 15 beyond the predetermined range of traveling of the quenching car 14 on the track, the limit switch 84 or 85 are closed thereby causing the opening of the change-over valve 80, so that the quenching car 14 likewise may be quickly and urgently stopped. Also, closing of the switch 86 for any correction causes the absolute mount which controls the slack or looseness in the wire rope 57 to be corrected.

The system operation control unit 16 is constructed so as to carry out each of such controls described above and may comprise a keyboard input unit 91 for inputting data such as a control program or the like, a CRT unit 92 for displaying the input data, a CPU (not shown) for processing the input data, a ROM for holding the control program or the like, and a RAM for temporarily storing input data or the like.

Now, the procedure or manner of automatically carrying out the controlled operation of the quenching car 14 in the illustrated embodiment constructed as described above will be described, hereinafter, with reference to FIG. 6.

In the system operation control unit 16, various control data, as well as data on the results of the execution of a schedule of coke delivery from the coke oven 11 which are fed from a wharf management sequence 103 and indicated at reference numeral 101 and data on a quenching management sequence 102 are stored.

Depending upon the results 101 of execution of the schedule, the coking chamber from which the next (current) coke delivery is to be carried out is designated as indicated as "DESIGNATION OF COKING CHAMBER" at reference numeral 104, following the input from the wharf managing sequence 103 or the input of data on the charging of coke into the wharf which has been last completed. Also, depending-upon the quenching management sequence 102, the current sprinkling time and draining time are set as indicated at reference numeral 105 and 106, respectively. Further, depending upon the wharf management sequence, the wharf into which the current coke charging is to be carried out is designated as indicated at 107.

When the coking chamber from which the current coke delivery is to be carried out is designated as indicated at reference numeral 104, a command on the designation is supplied to the pusher 21, resulting in the pusher 21 starting to travel to the designated coking chamber and the guide car 22 to which no instructions are given at this time starting to travel. Concurrently, controlled operation of the drive drum 55 by the winch structure 52 causes the quenching car 14 to start to travel to the designated coking chamber as indicated as "STEP OF START OF TRAVELING TO COKING CHAMBER" at reference numeral 201 in FIG. 6. When the quenching car 14 reaches the designated coking chamber and the corresponding proximity switch 23 detects the arrival of the quenching car 14, an and output comprising an output of the proximity switch 23 and an output of the encoder 60 of the winch structure 52 causes the quenching car 14 traveling to be stopped, resulting in the traveling of the quenching car being terminated as indicated as "STEP OF TERMINATION OF TRAVELING OF QUENCHING CAR" at reference numeral 202 in FIG. 6. Concurrently, the stopped quenching car 14 causes the limit switch 28 of the guide car 22 to be turned on.

The turn on of the limit switch 28, at reference numeral 109 of the guide car 22, the stopping of the guide car 18 and pusher 17 at the set positions which is confirmed by the fixed position of the pusher 21 occurs as is indicated by reference numeral 110, and the filling of the water tank 32 of the quenching tower 12, with water is indicated at reference numeral 111. This causes the completion of preparation of charging of coke into the quenching car 14 to be output as indicated as "STEP OF COMPLETION OF PREPARATION OF COKE CHARGING" at reference numeral 203, this output is then accomplished by the pusher 21, as indicated at reference numeral 112. At this point, the guide car 22 is stopped at the designated coking chamber from which coke is to be delivered and the quenching car 14 is stopped while being accurately aligned with the guide car 22, and then the delivery of calcined coke from the coking chamber is started by the pusher 21 as indicated as "STARTING OF DELIVERY OF COKE FROM COKING CHAMBER" at reference numeral 113.

Thus, when red-hot coke, as calcined is pushed out through the guide car 22, by the pusher 21, the controlled rotation of the drive drum 55 is restarted by the winch structure 52 occurs to permit the quenching car 14 to travel at a velocity corresponding to the velocity of delivery of coke from the coking chamber, resulting in "STEP OF START OF TRAVELING FOR CHARGING" indicated at reference numeral 204 and the advancing of a ram of the pusher 21 is displayed as indicated at reference numeral 114. Subsequently, red-hot coke is charged onto the quenching car 14 of which time the door 71 is closed and then an ultimate limit switch 115 of the ram of the pusher 21 is turned on to complete the pushing operation and the charging operation. Concurrently, a step of completion of charging and traveling of the quenching car 14 is displayed as indicated at reference numeral 205.

Then, backward movement of the ram of the pusher 21 is started as indicated at reference numeral 116 and the acceleration of the controlled rotation of the drive drum 55 caused by the winch structure 52 is commanded, so that a step of starting of traveling of the coke charged quenching car 14 to the quenching tower 12 is started, as indicated at reference numeral 206. This results in the ram of the pusher 21 retreating or returning to its original position and the quenching car 14 traveling to a predetermined position in the quenching space section 31 of the quenching tower 12. Then, an AND output comprising an output generated from the proximity switch 36 arranged at the predetermined position due to the turn on being sensed at reference numeral 117 and an output of the encoder 26 causes the travel of the quenching car 14 into the quenching tower 12 to be accurately stopped at the predetermined position, resulting in a step of completion of traveling of the quenching car 14 into the quenching tower 12 to be displayed.

Subsequently, under the conditions indicated by the setting of sprinkling time (reference numeral 105), a step of sprinkling red-hot coke charged onto the quenching car 14 with water is commanded for quenching it as indicated at reference numeral 208, so that water stored in the water tank 39 is sprinkled on the coke from the quenching nozzle 33 to quench it. Thereafter, the step of the completion of sprinkling for quenching indicated at reference numeral 209 is executed and then a step which causes the start of the draining from the quenched coke occurs at reference numeral 210. This is controlled and is commanded under the conditions indicated by the setting of draining time at reference numeral 106. Finally, a step of completion of the draining which is indicated at 211 is executed. In the process from the step 208 of sprinkling the red-hot coke with water for quenching to the step 211 of completing the draining shown in FIG. 6, the current collector 66 provided on the quenching car 14 is in contact with the conductive shoe 38, arranged in the quenching tower 12 thereby supplying the quenching car with electric power when the quenching car 14 is stopped at the predetermined position in the quenching space section 31 of the quenching tower 12, so that the air compressing structure 75 mounted on the quenching car 14 is actuated to permit the required amount of compressed air to be stored under a predetermined pressure in the air tank 78 for a period of time during which the quenching and sprinkling take place in the quenching tower 12.

The quenching car 14, as described above, is provided thereon with the air compressing structure 75, which comprises the motor 76, air compressor 77 and air tank 78 and is constructed so as to actuate the door for discharging charged coke through the pneumatic cylinder operation mechanism 72 and brake the traveling wheels 73 through the pneumatic cylinder brake mechanism 74. The so-constructed air compressing structure 75 is supplied with electric power from the electric collector 66 for a period of time during which the quenching operation is carried out in the quenching tower 12, resulting in being operated, so that a required amount of compressed air may be stored under a required pressure in the air tank 78.

Figure 6:
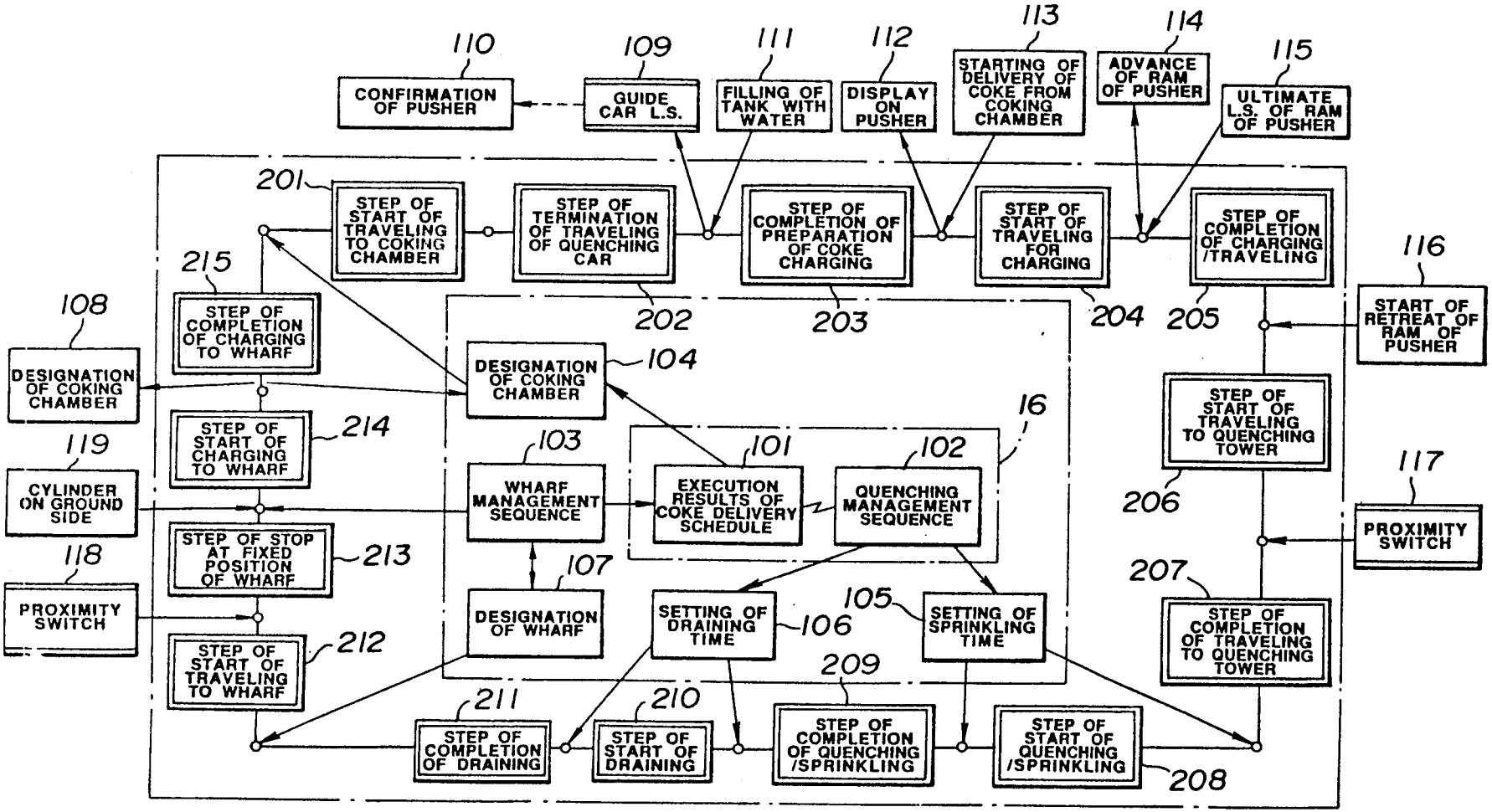
FIG. 6 is a block diagram showing the procedure or manner of automatically controlled operation of a quenching car in the embodiment shown in FIG. 1.

When the draining is completed as described above, the controlled rotation of the drive drum 55 through the winch structure 52 is commanded, and the quenching car 14 starts to travel from the quenching space section 31 of the quenching tower 12 to a predetermined position of one of the wharves which is designated according to the wharf designation 107 as indicated as "STEP OF START OF TRAVELING TO WHARF" at reference numeral 212 in FIG. 6. Then, when the traveling is completed, the corresponding proximity switch 43 detects the completion, so that an AND output constituted by an output generated from the proximity switch 43 due to the turning-on and an output of the encoder 60 permits the quenching car 14 to be accurately stopped at the predetermined position of the designated wharf, resulting in a step of stopping the quenching car 14 at the predetermined position of the designated wharf being completed as indicated at reference numeral 213. Then, the change-over valve 79 of the air compressing structure 75 mounted on the quenching car 14 is operated so as to render opposite the door operation command of the pneumatic cylinder 81 of the designated wharf as indicated at reference numeral 119.

Subsequently, when the change-over valve 82 is rendered open due to control by the wharf management sequence (reference numeral 103), compressed air supplied from an external compressed air source causes the door operation command pneumatic cylinder 81 to be actuated to externally open the change-over valve 79, so that the pneumatic cylinder operation mechanism 72 may be actuated to lead to a step of start of charging to the designated wharf which is indicated at reference numeral 214. This causes the door 71 to be operated, resulting in discharge of coke to the designated wharf being executed. Then, when the discharge is completed, the step of complete charging of coke to the designated wharf is executed as indicated at reference numeral 215, in readiness for the next coke delivery. Thus, one cycle of the coke deliver from the coke oven by the quenching car 14 is completed.

Now, the manner of controlled operation of the bucket car for the coke oven win be described hereinafter. The manner of operation and control of the quenching car 14 described above can be applied to a bucket car by substituting a bucket car and a CDQ for the quenching car and quenching tower coke wharf, respectively. To this end, in the embodiment shown in FIG. 1 to 5, reference numerals 12 and 14 designate a CDQ and a bucket car traveling on the track 15 while being controlled, respectively.

The CDQ 12 is constructed so as to subject red-hot coke charged in a coke bucket on the bucket car 14 to dry quenching in a conventional manner as is well known in the art. For this purpose, the CDQ 12 may be arranged, for example, on the distal end side of the track 15, and a charging crane for vertically operating the coke bucket may be operated and controlled through a sequencer 18 depending upon a control command generated from a system operation control unit 16.

The bucket car 14, as described above, is charged with red-hot coke by receiving, in the coke bucket mounted thereon, the coke pushed out from a designate coking chamber by a pusher 17 and then caused to travel to a predetermined position of the CDQ 12. The traveling of the bucket car 14 is carried out according to any one of wire rope traction systems such as the systems shown in FIGS. 3A to 3D.

Figure 3A:
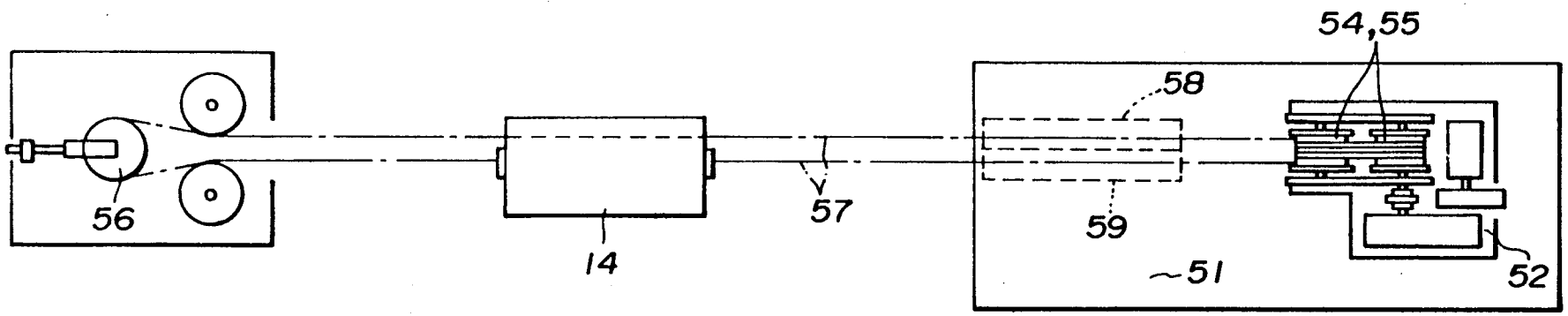
FIGS. 3A, 3B, 3C and 3D are each a diagrammatic views schematically showing the manner of drawing a wire rope for traction of a quenching car.
Figure 3B:
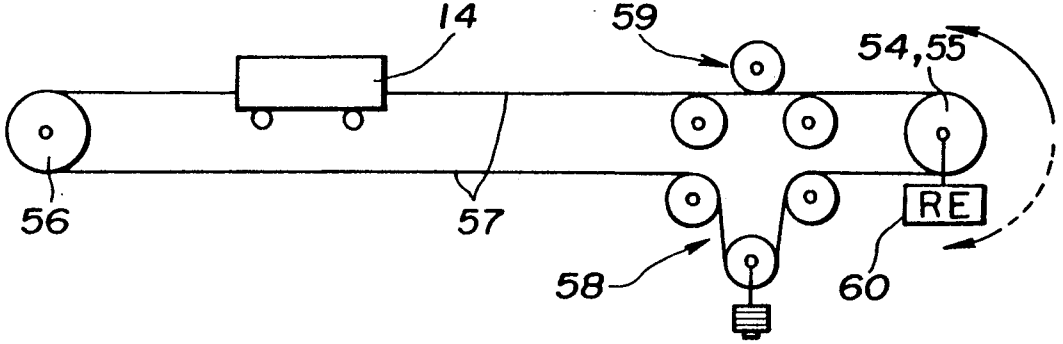

Various embodiments of the wire rope traction system are shown in FIGS. 3A and 3B. More particularly, a machine room 51 arranged on the proximal end side of the track 15 is provided therein with a winch structure 52 equipped with a brake mechanism 53 for a brake drum 54 and includes a wire rope 57 arranged in a manner to be multiplexly wound on a drive drum 55 of the winch structure 52 and connected through a driven drum 56 arranged on the proximal end side of the track 15 to the front and rear portions of the bucket car 14. Such construction leads to controlled rotation of the drive drum 55 in both directions or the driving of the drive drum 55 due to controlled drawing by the wire rope 57 through the winch structure 52, resulting in the bucket car 14 reciprocatedly traveling on the track 15 with respect to a coke oven 11, the CDQ 12 and coke wharves 13 while being stopped at the predetermined positions through proximity switches 23 and 28 respectively arranged at the coke oven 11 and CDQ 12.

Also, in order to absorb extension of the wire rope 57, as well as looseness of the wire rope 57 at the start of traveling of the bucket car 14, to thereby prevent slippage of the wire rope 57 on the drive drum 55, a main-weight mechanism 58 and a sub-weight mechanism 59 are arranged on one return side of the wire rope 57 not directly connected to a body of the bucket car 14 and on the other return side of the wire rope 57 directly connected to the body of the bucket car 14, respectively.

The winch structure 52 is provided with an encoder 60 acting as a relative address position detecting means which functions to carry out the detection of rotation and rotational angular position of the drive drum 55 as indicated as "DETECTION OF POSITION OF DRUM" at reference numeral 61 and the detection of rotational speed of the drive drum 55 as indicated as "DETECTION OF SPEED OF DRUM" at reference numeral 62 to generate detection data. The control of rotation of the drive drum 55 in both directions through the winch structure 52 is carried out by means of a winch drive control unit 63 based on the detection data supplied thereto depending upon a control command supplied from the system operation control unit 16. Concurrently, the brake mechanism 53 is controlled by the winch control unit 63 to control the brake drum 54, so that the bucket car 14 may be accurately stopped at each of predetermined address positions and urgently stopped.

The track 15 is provided on the proximal and distal ends thereof with limit switches 84 and 85 for regulating the range of traveling of the bucket car 14 on the track 15, to thereby prevent the reckless travel of the bucket car 14 as indicated by reference numeral 73. Also, the track 15 is provided thereon with a limit switch 86 for detecting an absolute address on the track 15 or an absolute address with respect to a control system of the bucket car 14 with respect to the wire rope 57, resulting in corrections being possible.

The bucket car 14 includes a conductive plate arranged corresponding to the proximity switch 23 for the defection of stop of the bucket car 14 at predetermined positions in front of the coking chambers as indicated at reference numeral 24 and a conductive plate arranged corresponding to proximity switches 36 which carries out the detection of stop of the bucket car 14 at a predetermined position of the CDQ.

Figure 3C:
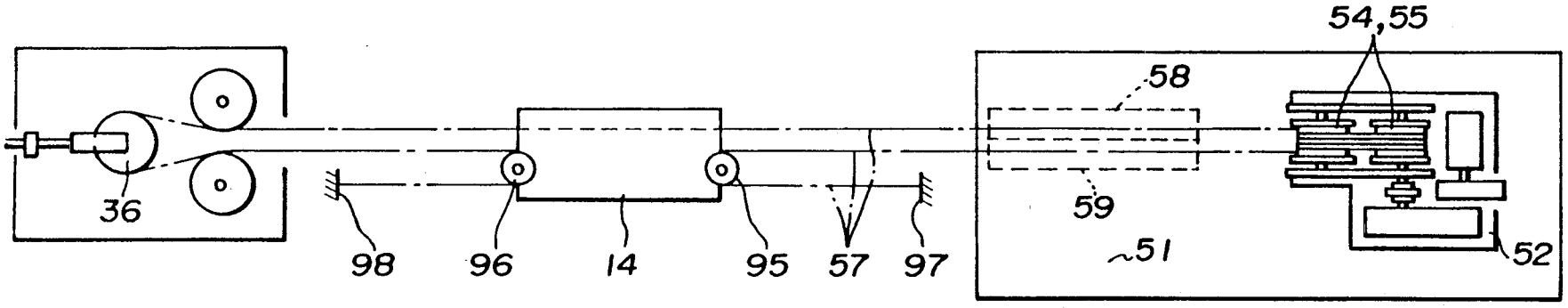

Referring to FIG. 3C showing a wire rope traction system of another embodiment, with the wire rope traction system being constructed in a different manner from the above-described system wherein a wire rope 57 stretchedly arranged between a drive drum 55 of a winch structure 52 and a driven drum 56 are connected at both ends thereof directly to the bucket car 14. More particularly, in the wire rope traction system shown in FIG. 3C, the wire rope 57 is arranged so as to extend through intermediate blocks or pulleys 95 and 96 arranged on both sides of the bucket car 14 while turning back therearound, so that the wire rope 57 is fixed at both ends thereof on the proximal and distal end sides of the track 15 as indicated at reference numerals 97 and 98, resulting in the system exhibiting substantially the same function and advantage as the above—described system and ensuring the smooth travel of the bucket car 14.

Figure 3D:
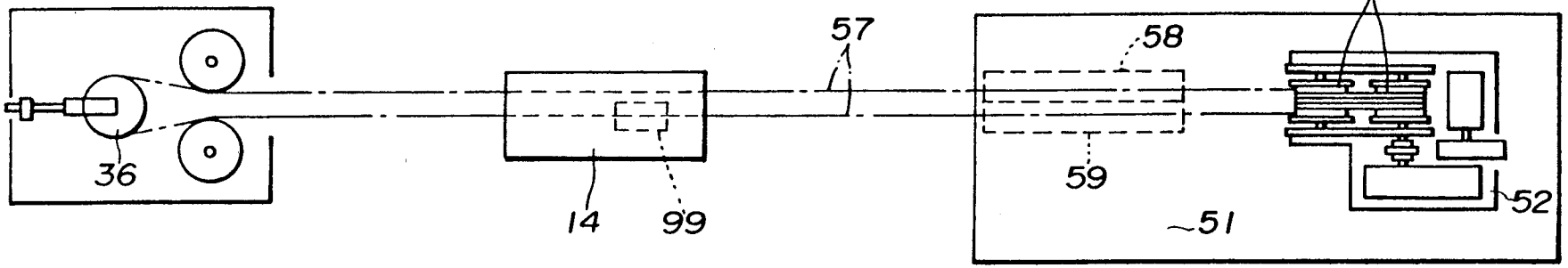

FIG. 3D shows a wire rope traction system of yet another embodiment, wherein a wire rope 57 is stretchedly arranged between a drive drum 55 of a winch structure 52 and a driven drum 56 in an endless manner and is grasped through a suitable grasp means 99 arranged on the side of the bucket car 14. Such construction of the wire rope traction system shown in FIG. 3D likewise permits it to exhibit substantially the same operation and advantage as the system shown in FIGS. 3A and 38. Also, a variation in positions at which the grasping means grasps the wire rope 57 permits local fatigue of the wire rope 57 to be avoided and replacement of the wire rope to be facilitated.

Figure 7:
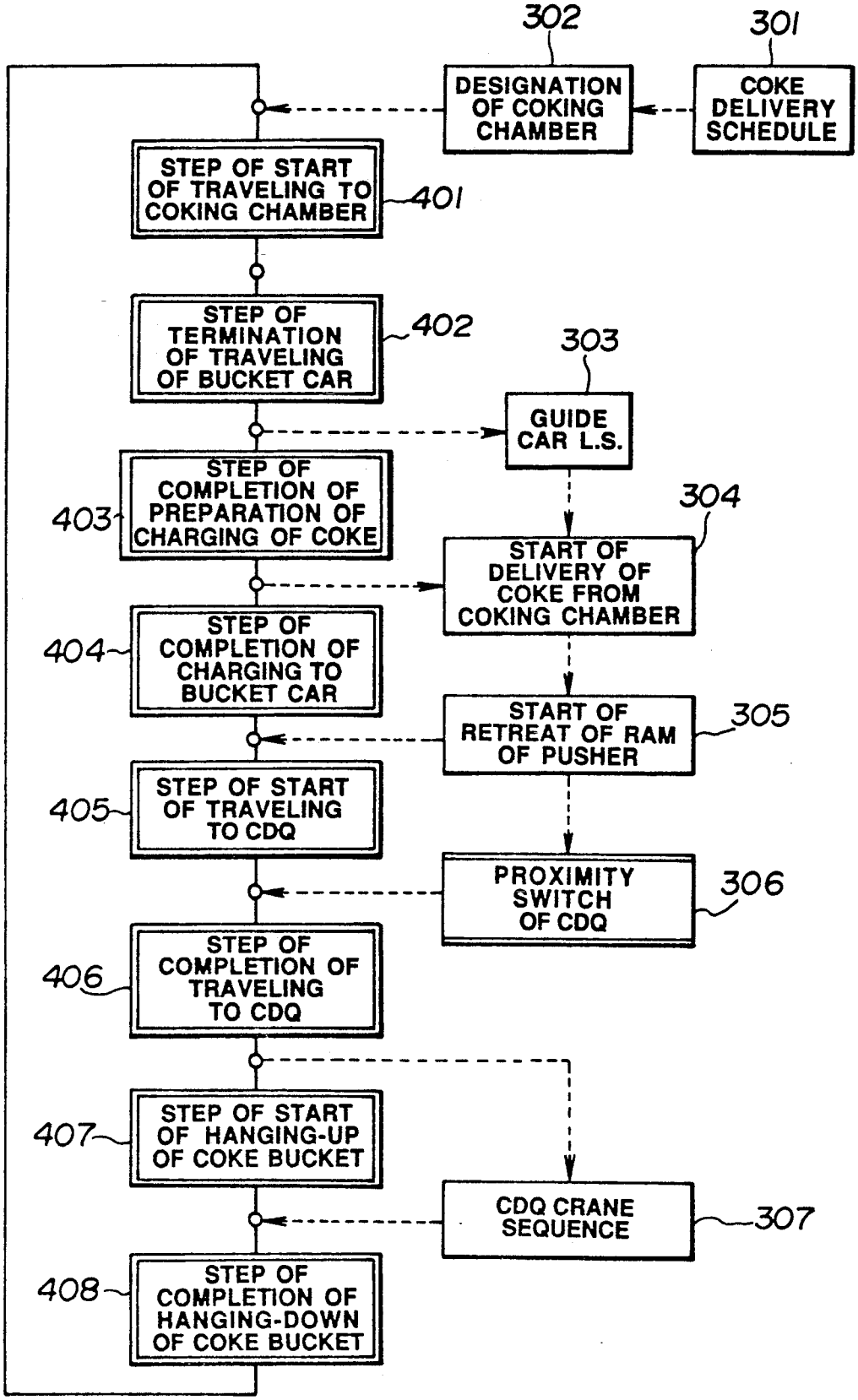
FIG. 7 is a flow chart showing the manner of controlling of CDQ bucket car.

Now, the manner or procedure of controlled operation or driving of the bucket car 14 for the coke oven will be described hereinafter with reference to FIG. 7.

When the coking chamber from which the next coke delivery is to be carried out is designated as indicated at reference numeral 302, the guide car 22 to which no instructions are given at this time starts to travel. Concurrently, controlled operation of the drive drum 55 by the winch structure 52 causes the bucket car 14 to start to travel to the designated coking chamber as indicated as "STEP OF START OF TRAVELING TO COKING CHAMBER" at reference numeral 401 in FIG. 7. When the bucket car 14 reaches the designated coking chamber and the corresponding proximity switch 23 detects the arrival of the bucket car 14, an AND output comprising an output of the proximity switch 23 and an output of the encoder 60 of the winch structure 52 causes the bucket car 14 traveling to be stopped, resulting in the traveling of the bucket car being terminated as indicated as "STEP OF TERMINATION OF TRAVELING OF BUCKET CAR" at reference numeral 402 in FIG. 7. Concurrently, the stopped bucket car 14 causes the limit switch 28 of the guide car 22 to be turned on.

The turn on of this limit switch 28 is sensed at reference numeral 303 for the guide car 22 causes the completion of preparation of the charging of coke into the bucket car 14 to be output as indicated as "STEP OF COMPLETION OF PREPARATION OF CHARGING OF COKE" at reference numeral 403, which point an output is then displayed on the pusher 21. At this state, the guide car 22 is stopped at the designated coking chamber from which coke is delivered and the bucket car 14 is stopped while being accurately aligned with the guide car 22, and then the delivery of calcined coke from the designated coking chamber is started by the pusher 21 as indicated as "START OF DELIVERY OF COKE FROM COKING CHAMBER" at reference numeral 304.

Thus, when red-hot coke as calcined is pushed out through the guide car 22 by the pusher 21 and charged in a coke bucket on the bucket car 14, resulting in a step of completion of charging to the bucket car 14 being displayed as indicated by reference numeral 404. Then, backward movement of a ram of the pusher is started as indicated at reference numeral 305 and the controlled rotation of the drive drum 55 by the winch structure 52 is commanded again, so that the step of start of traveling of the coke charged bucket car 14 to the CDQ 12 is started as indicated at reference numeral 405. This results in the ram of the pusher retreating or returning to the original position and the bucket car 14 traveling to the predetermined position of the CDQ 12. Then, an AND output comprising an output generated from the corresponding proximity switch 36 due to the turn on sensed at reference numeral 306 and an output of the encoder 40 causes the traveling of the bucket car 14 into the CDQ 12 to be accurately stopped at the predetermined position, resulting in a step of completion of traveling of the bucket car 14 into the CDQ 12 being displayed.

Then, a CDQ crane sequence 307 causes a step of start of hanging-up of the charged coke bucket of the bucket car 14 indicated at reference 409 to occur. When the coke bucket charged with red-hot coke is hung up and the transshipment is completed, a command from the CDQ crane sequence (reference numeral 307) causes the completion of the hanging-down of the coke bucket as indicated at reference numeral 409 to be carried out, thereby rendering the coke bucket empty, which is then hung down on the bucket car 14. This results in a step of completion of hanging-down of the coke bucket to be displayed. Thus, one cycle of the coke delivery from the coke oven by the bucket car 14 is completed and then the operation is repeated.

As can be seen from the foregoing, the present invention, as described above, is constructed so as to permit a quenching car/bucket car to travel due to traction by a wire rope through a winch structure. Such construction permits the load of the quenching car/bucket car which is applied to a track surface to be substantially reduced to prevent positional variations in the track surface; so that a relative positional relationship of the track surface and therefore the quenching car/bucket car to a quenching tower, a coke wharf/CDQ and the like can be ensured. The operation control system may also be significantly simplified, resulting in the operation and control of the quenching car/bucket car being efficiently and positively accomplished, and the cost of equipment may be highly decreased. Also, in the present invention, a desired operation is carried out according to the preset operation program when detection of the required operational position of the quenching car by the traveling position detecting means and confirmation of the operational position of the quenching car by the operational position detecting means coincide with each other. Accordingly, the operation by the quenching car/bucket car and therefore the operation of delivery of coke from the coke oven may be efficiently and satisfactorily accomplished. In addition, the present invention eliminates costs required for strengthening or reinforcing the track and simplifies the construction of the apparatus and the control operation.

Further, the wire rope stretching means is provided with respect to the wire rope acting as a traction means, to thereby effectively absorb extension and looseness of the wire rope to prevent slippage of the wire rope on the drive drum. This results in the position of the quenching car/bucket car traveling on the track being accurately grasped or detected depending upon the amount of driving of the winch structure. In addition, the arrangement of an urgent stopping means detects abnormal extension or cutting of the wire rope to urgently stop the quenching car/bucket car, to thereby prevent any trouble or accident from occurring due to abnormality in traction by the wire rope. Moreover, the arrangement of an out-of-range detection means permits out-of-range traveling of said bucket car to be positively detected, to thereby urgently stop the bucket car when the out-of-range detection means detects any out of range travel of the bucket car.

Moreover, the present invention is so constructed that the winch structure is provided with the relative address position detecting means for detecting the relative address position of the quenching car on the track based on the rotational angle position of the drive drum to control the winch drive control structure and the track is provided at the portion thereof within the range of traveling of the quenching car with the absolute address correcting means for detecting an absolute address position of the quenching car on the track due to passage of the quenching car to correct the quenching car operating data of the winch drive control structure; so that the winch drive control structure permits the quenching car to travel on the track depending upon the absolute address correction.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An apparatus for controlling the operation of a quenching car for a coke oven in which the quenching car is actuated in association with a pusher to travel on a track and charged with calcined coke pushed out from a designated coking chamber of the coke oven by the pusher and the quenching car is moved into a quenching tower for quenching the coke and then moved to designated one of coke wharves for discharging the coke to the coke wharf, comprising:

a quenching car operating means for connecting a wire rope to said quenching car and drawing said wire rope due to driving of a winch structure to reciprocate said quenching car on said track;

a traveling position detecting means for detecting a required operational position of said quenching car on said track depending upon the amount of driving of said winch structure; and an operational position detecting means for confirming approach of said quenching car to a position at which coke is delivered from said designated coking chamber, a quenching position in said quenching tower and a position at which coke is discharged from said quenching car to said designated coke wharf;

whereby a desired operation is carried out according to a preset operation program when detection of the required operational position of said quenching car by said traveling position detecting means and confirmation of the operational position of said quenching car by said operational position detecting means coincide with each other.

2. An apparatus as defined in claim 1, further comprising:

a detection means for detecting a failure in traction by said wire rope, so that said quenching car is urgently stopped when said detection means detects said failure in traction of said wire rope.

3. An apparatus as defined in claim 1 or 2, further comprising:

two out-of-range detection means one provided at each end of said track for detecting any out-of-range travel of said quenching car;

stopping means for stopping said quenching car when either of said out-of-range detection means detects any out-of-range travel of said quenching car.

4. An apparatus as defined in claim 3, further comprising:

a door operating means arranged corresponding to each of said coke wharves so as to operate a door of said quenching car.

5. An apparatus as defined in claim 1, wherein said quenching car operating means connects said wire rope extending in an endless manner between a drive drum and a driven drum arranged on both ends sides of said track to said quenching car; and further comprising:

a drive structure arranged so as to cause said drive drum to be rotated by said winch structure to reciprocate said quenching car on said track due to traction through said wire rope.

6. An apparatus as defined in claim 1, further comprising:

means for connecting said car operating means to said wire rope such that said wire rope extends in an endless manner between a drive drum and a driven drum arranged on both ends sides of said track to said quenching car;

a means to allow said winch structure to reciprocate said quenching car on said track due to traction through said wire rope by rotation of said drive drum;

actuation means for actuating said winch structure through a winch drive control structure for driving said winch structure according to a predetermined quenching car operating data;

wherein said winch structure is provided with a relative address position detecting means for detecting a relative address position of said quenching car on said track based on a rotational angle position of said drive drum to control said winch drive control structure; and said track is provided at the portion thereof, within the range of traveling of said quenching car, with an absolute address correcting means for detecting an absolute address position of said quenching car on said track due to passage of said quenching car to correct the quenching car operating data of said winch drive control structure;

whereby said winch drive control structure permits said quenching car to travel on said track depending upon the absolute address correction.

7. An apparatus as defined in claim 6, wherein said absolute address correcting means comprises:

an encoder for detecting the rotational angle position of said drive drum.

8. An apparatus as defined in claim 6, wherein said absolute address correcting means comprises:

a switch means for detecting the passage of said quenching car.

9. An apparatus as defined in claim 5, further comprising;

a wire rope stretching means coupled to said wire rope for absorbing extension of said wire rope and looseness of said wire rope at the time when the traveling of said quenching car starts to prevent slippage of said wire rope on said drive drum; and an urgent stop means for detecting abnormal extension or cutting of said wire rope to urgently stop said quenching car.

10. An apparatus as defined in claim 5, wherein said track is provided at each of both ends thereof with an out-of-range detection means for detecting out-of-range traveling of said quenching car, so that said quenching car is urgently stopped when said out-of-range detection means detects out-of-range traveling of said quenching car.

11. An apparatus for controlling the operation of a bucket car for a coke oven in which the bucket car is actuated in association with a pusher to travel on a track and includes a coke bucket charged therein with calcined coke pushed out from a designated coking chamber of the coke oven by the pusher and the bucket car is moved into a coke dry quenching facility for quenching the coke, comprising:

a bucket car operating means for connecting a wire rope to said bucket car and drawing said wire rope due to driving of a winch structure to reciprocate said bucket car on said track;

a traveling position detecting means for detecting a required operational position of said bucket car on said track depending upon the amount of driving of said winch structure; and an operational position detecting means for confirming approach of said bucket car to a position at which coke is delivered from said designated coking chamber to said bucket car, a quenching position in said coke dry quenching facility and other desired operating positions;

whereby a desired operation is carried out according to a preset operation program when detection of the required operational position of said bucket car by said traveling position detecting means and confirmation of the operational position of said bucket car by said operational position detecting means coincide with each other.

12. An apparatus as defined in claim 11, further comprising:

a detection means for detecting a failure in traction by said wire rope, so that said bucket car is urgently stopped when said detection means detects said failure in traction by said wire rope.

13. An apparatus as defined in claim 11 or 12, wherein said track is provided at each of both ends thereof with an out-of-range detection means for detecting out-of-range traveling of said bucket car, so that said bucket car is urgently stopped when said out-of-range detection means detects out-of-range traveling of said bucket car.

14. An apparatus as defined in claim 13, wherein the connection of said wire rope to said bucket car in said bucket car operating means is carried out by connecting both ends of said wire rope extending between a drive drum of said winch structure and its driven drum to the front and rear portions of a body of said bucket car.

15. An apparatus as defined claim 13, wherein the connection of said wire rope to said bucket car in said bucket car operating means is carried out by turning back, through intermediate pulleys pivotally supported on the front and rear portions of a body of said bucket car, said wire rope extending between a drive drum of said winch structure and its driven drum and connecting both ends of said wire rope to the proximal and distal ends of said track, respectively.

16. An apparatus as defined in claim 13, wherein the connection of said wire rope to said bucket car in said bucket car operating means is carried out by extending said wire rope in an endless manner between a drive drum of said winch structure and its driven drum and releasable connecting said wire rope to fixing means provided on said bucket car.

17. An apparatus as defined in claim 16, wherein said drive drum of said winch structure is provided with a brake mechanism.

* * * * *

UNITED STATES PATENT AND TRADEMARK OFFICE

CERTIFICATE OF CORRECTION

PATENT NO. : 5,314,168

DATED : May 24, 1994

INVENTOR(S) : Yoshihiro OMAE, et al.

It is certified that error appears in the above-indentified patent and that said Letters Patent is hereby corrected as shown below:

On the title page, Item [30], the Foreign Application Priority Data should read as follows:

--[30] Foreign Application Priority Data

| | | | |
|---|---|---|---|
| Jul. 24, 1990 | [JP] | Japan | 2-193884 |
| Jul. 24, 1990 | [JP] | Japan | 2-193885 |
| Jul. 24, 1990 | [JP] | Japan | 2-193886 |
| Aug. 28, 1990 | [JP] | Japan | 2-224492 |
| Nov. 7, 1990 | [JP] | Japan | 2-299739 |
| Nov. 7, 1990 | [JP] | Japan | 2-299740-- |

Signed and Sealed this

Sixteenth Day of August, 1994

*Attest:*

*Attesting Officer*

Bruce Lehman

BRUCE LEHMAN

*Commissioner of Patents and Trademarks*